US011391296B1

(12) United States Patent
Duong et al.

(10) Patent No.: US 11,391,296 B1
(45) Date of Patent: Jul. 19, 2022

(54) DIFFUSER PIPE WITH CURVED CROSS-SECTIONAL SHAPES

(71) Applicant: PRATT & WHITNEY CANADA CORP., Longueuil (CA)

(72) Inventors: Hien Duong, Mississauga (CA); Jason Nichols, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/369,797

(22) Filed: Jul. 7, 2021

(51) Int. Cl.
*F04D 29/44* (2006.01)
*F04D 17/10* (2006.01)

(52) U.S. Cl.
CPC ..... *F04D 29/444* (2013.01); *F04D 17/10* (2013.01)

(58) Field of Classification Search
None
See application file for complete search history.

(56) References Cited

U.S. PATENT DOCUMENTS 5,338,155 A * 8/1994 Kreitmeier ..... F01D 25/30 415/211.2
6,220,816 B1 * 4/2001 Nguyen Duc ..... F04D 29/441 415/199.1
8,038,392 B2 10/2011 Honda et al.
8,066,484 B1 * 11/2011 Liang ..... F01D 5/186 415/115
10,794,395 B2 10/2020 Tamada
2001/0047836 A1 * 12/2001 Welker ..... F15D 1/04 138/46
2003/0235497 A1 * 12/2003 Meng ..... F04D 29/444 415/208.3
2005/0229605 A1 * 10/2005 Bouchard ..... F02C 7/04 137/15.1
2007/0028647 A1 * 2/2007 Wang ..... F28D 7/16 62/506
2011/0126510 A1 * 6/2011 Kenyon ..... F02C 5/00 60/247
2012/0034064 A1 * 2/2012 Nanda ..... F01D 25/30 415/206
2012/0051941 A1 * 3/2012 Bunker ..... F01D 5/186 416/97 R
2012/0325325 A1 * 12/2012 Quackenbush ..... F02C 7/04 137/15.1
2015/0226232 A1 * 8/2015 Duong ..... F04D 29/684 415/203
2016/0187037 A1 * 6/2016 Jeong ..... B05B 7/24 239/398
2016/0290225 A1 * 10/2016 Armit ..... F23R 3/26
2017/0283080 A1 * 10/2017 Evulet ..... B64C 15/00
2017/0335691 A1 * 11/2017 Crites ..... F23R 3/002
2018/0313231 A1 * 11/2018 Kim ..... F04D 29/684
2018/0355886 A1 * 12/2018 Fujiwara ..... F04D 17/10
(Continued)

*Primary Examiner* — Michael Lebentritt
(74) *Attorney, Agent, or Firm* — Norton Rose Fulbright Canada LLP

(57) ABSTRACT

A diffuser pipe has a tubular body extending from an inlet to an outlet and increasing in cross-sectional area from the inlet toward the outlet. The outlet has a radially inner wall, a radially outer wall, and side walls joining the radially inner wall to the radially outer wall. The outlet has an elliptigon shape in which both the radially inner wall and the radially outer wall are curved. A radius of curvature of the radially outer wall is different from a radius of curvature of the radially inner wall.

20 Claims, 4 Drawing Sheets

(56) References Cited

U.S. PATENT DOCUMENTS

| | | | | |
|---|---|---|---|---|
| 2019/0226488 | A1* | 7/2019 | Tawfik | F04D 29/681 |
| 2020/0132086 | A1* | 4/2020 | Drolet | F01D 9/06 |
| 2020/0200008 | A1* | 6/2020 | Montie | F01C 1/104 |
| 2020/0318649 | A1* | 10/2020 | Duong | F02C 3/08 |
| 2020/0378303 | A1* | 12/2020 | Nichols | F04D 29/284 |
| 2020/0393129 | A1* | 12/2020 | Duong | F01D 9/02 |

* cited by examiner

DIFFUSER PIPE WITH CURVED CROSS-SECTIONAL SHAPES

TECHNICAL FIELD

The application relates generally to centrifugal compressors, and more particularly to diffuser pipes for such centrifugal compressors.

BACKGROUND

Diffuser pipes are provided in certain engines for diffusing a flow of high speed air received from an impeller of a centrifugal compressor and directing the flow to a downstream component, such as an annular chamber containing the combustor. The diffuser pipes are typically circumferentially arranged at a periphery of the impeller, and are designed to transform kinetic energy of the flow into pressure energy. Diffuser pipes seek to provide a uniform exit flow with minimal distortion, as it is preferable for flame stability, low combustor loss, reduced hot spots etc.

SUMMARY

There is disclosed a compressor diffuser for an aircraft engine, the compressor diffuser comprising: a plurality of diffuser pipes disposed circumferentially about a center axis of the compressor diffuser, the center axis extending in an axial direction, each diffuser pipe of the plurality of diffuser pipes: extending from an inlet of that diffuser pipe to an outlet of that diffuser pipe and increasing in cross-sectional area from the inlet toward the outlet, the outlet opening in the axial direction, at least the outlet defined by a radially inner wall, a radially outer wall, and side walls joining the radially inner wall to the radially outer wall, and both the radially inner wall and the radially outer wall being curved, a radius of curvature of the radially outer wall being different from a radius of curvature of the radially inner wall.

There is disclosed a diffuser pipe, comprising: a tubular body extending from an inlet to an outlet and increasing in cross-sectional area from the inlet toward the outlet, the outlet having a radially inner wall, a radially outer wall, and side walls joining the radially inner wall to the radially outer wall, the outlet having an elliptigon shape in which both the radially inner wall and the radially outer wall are curved, a radius of curvature of the radially outer wall being different from a radius of curvature of the radially inner wall.

DESCRIPTION OF THE DRAWINGS

Reference is now made to the accompanying figures in which.

DETAILED DESCRIPTION

Figure 1:
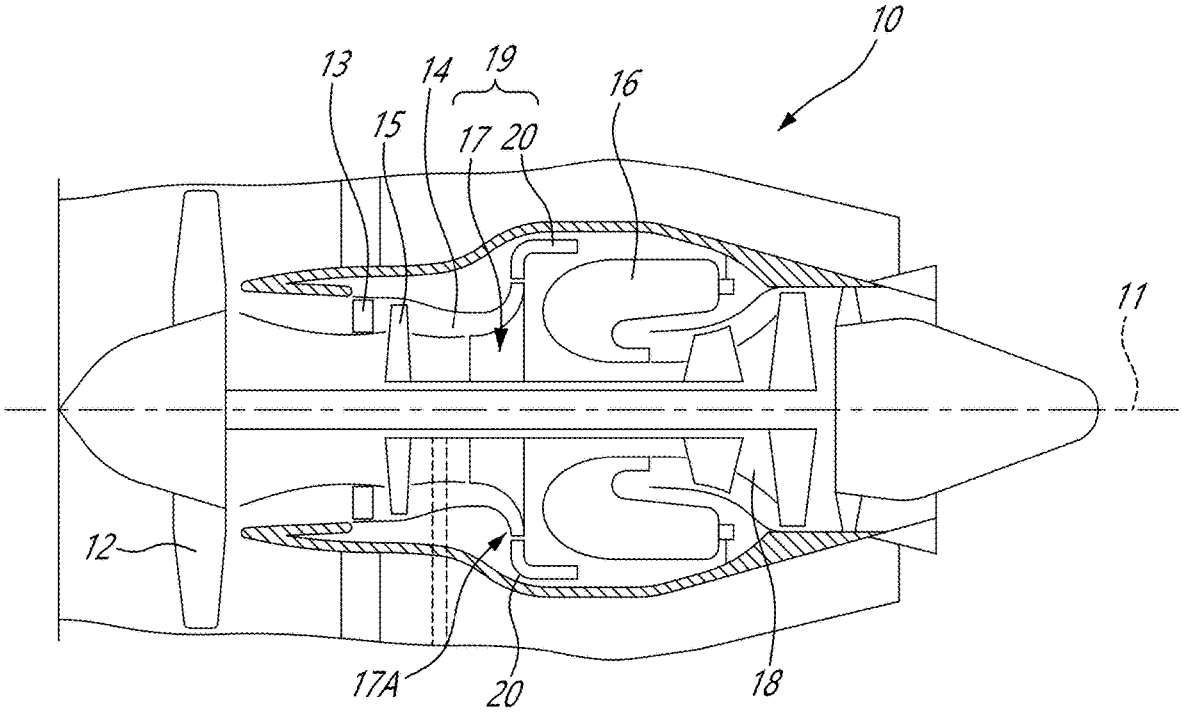
FIG. 1 is a schematic cross-sectional view of an engine.

FIG. 1 illustrates a gas turbine engine 10 of a type preferably provided for use in subsonic flight, generally comprising in serial flow communication along an engine center axis 11 a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The compressor section 14 may include a plurality of stators 13 and rotors 15 (only one stator 13 and rotor 15 being shown in FIG. 1), and it may include a centrifugal compressor 19.

The centrifugal compressor 19 of the compressor section 14 includes an impeller 17 and a plurality of diffuser pipes 20, which are located downstream of the impeller 17 and circumferentially disposed about a periphery of a radial outlet 17A of the impeller 17. The diffuser pipes 20 convert high kinetic energy at the impeller 17 exit to static pressure by slowing down fluid flow exiting the impeller. The diffuser pipes 20 may also redirect the air flow from a radial orientation to an axial orientation (i.e. aligned with the engine axis 11). In most cases, the Mach number of the flow entering the diffuser pipe 20 may be at or near sonic, while the Mach number exiting the diffuser pipe 20 may be less than 0.25 to enable stable air/fuel mixing, and light/re-light in the combustor 16.

Figure 2:
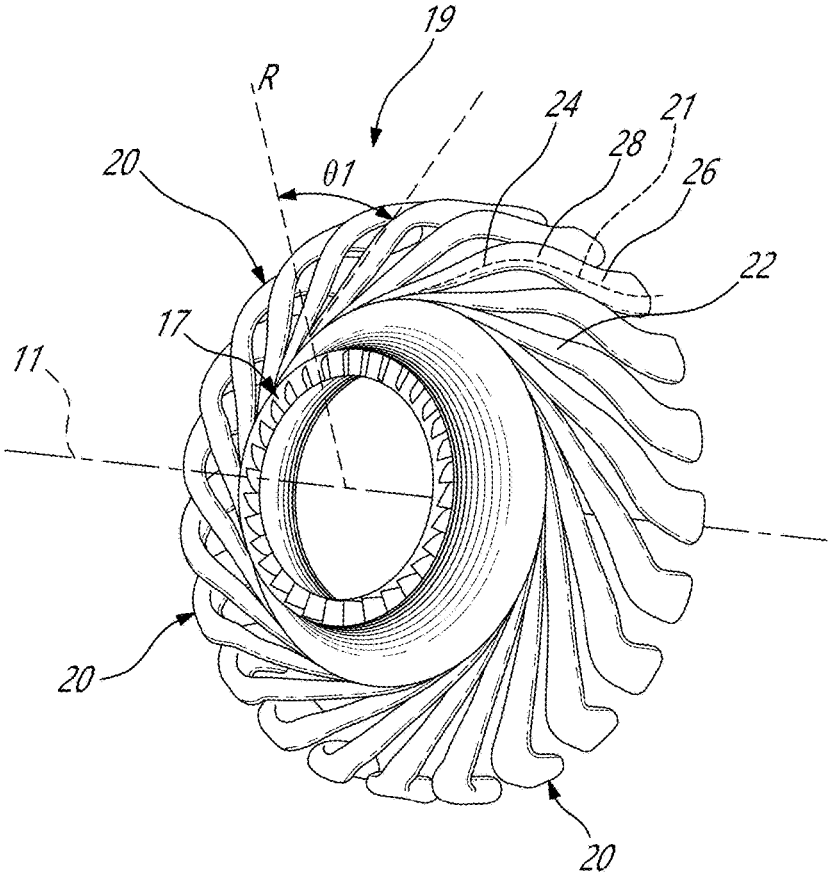
FIG. 2 is a perspective view of an impeller and diffuser pipes of a centrifugal compressor of the engine of FIG. 1.

FIG. 2 shows the impeller 17 and the plurality of diffuser pipes 20, also referred to as "fishtail diffuser pipes", of the centrifugal compressor 19. Each of the diffuser pipes 20 includes a diverging (in a downstream direction) tubular body 22, formed, in one embodiment, of sheet metal. The enclosed tubular body 22 defines a flow passage 29 (see FIG. 3A) extending through the diffuser pipe 20 through which the compressed fluid flow is conveyed. The tubular body 22 includes a first portion 24 extending generally tangentially from the periphery and radial outlet 17A of the impeller 17. An open end is provided at an upstream end of the tubular body 22 and forms an inlet 23 (see FIG. 3A) of the diffuser pipe 20. The first portion 24 may be inclined at an angle 81 relative to a radial axis R extending from the engine axis 11. The angle 81 may be at least partially tangential, or even substantially tangentially, and may further correspond to a direction of fluid flow at the exit of the blades of the impeller 17, such as to facilitate transition of the flow from the impeller 17 to the diffuser pipes 20. The first portion 24 of the tubular body 22 can alternatively extend more substantially along the radial axis R.

The tubular body 22 of the diffuser pipes 20 also includes a second portion 26, which is disposed generally axially and is connected to the first portion 24 by an out-of-plane curved or bend portion 28. An open end at the downstream end of the second portion 26 forms a pipe outlet 25 (see FIG. 3A) of the diffuser pipe 20. Preferably, but not necessarily, the first portion 24 and the second portion 26 of the diffuser pipes 20 are integrally formed together and extend substantially uninterrupted between each other, via the curved, bend portion 28.

The large radial velocity component of the flow exiting the impeller 17, and therefore entering the first portion 24 of each of the diffuser pipes 20, may be removed by shaping the diffuser pipe 20 with the bend portion 28, such that the flow is redirected axially through the second portion 26 before exiting via the pipe outlet 25 to the combustor 16. It will thus be appreciated that the flow exiting the impeller 17 enters the inlet 23 and the upstream first portion 24 and flows along a generally radial first direction. At the outlet of the first portion 24, the flow enters the bend portion 28 which functions to turn the flow from a substantially radial direction to a substantially axial direction. The bend portion 28 may form a 90 degree bend. At the outlet of the bend portion 28, the flow enters the downstream second portion 26 and flows along a substantially axial second direction different from the generally radial first direction. By "generally radial", it is understood that the flow may have axial, radial, and/or circumferential velocity components, but that the axial and circumferential velocity components are much smaller in magnitude than the radial velocity component. Similarly, by "generally axial", it is understood that the flow may have axial, radial, and/or circumferential velocity components, but that the radial and circumferential velocity components are much smaller in magnitude than the axial velocity component.

Figure 3A:
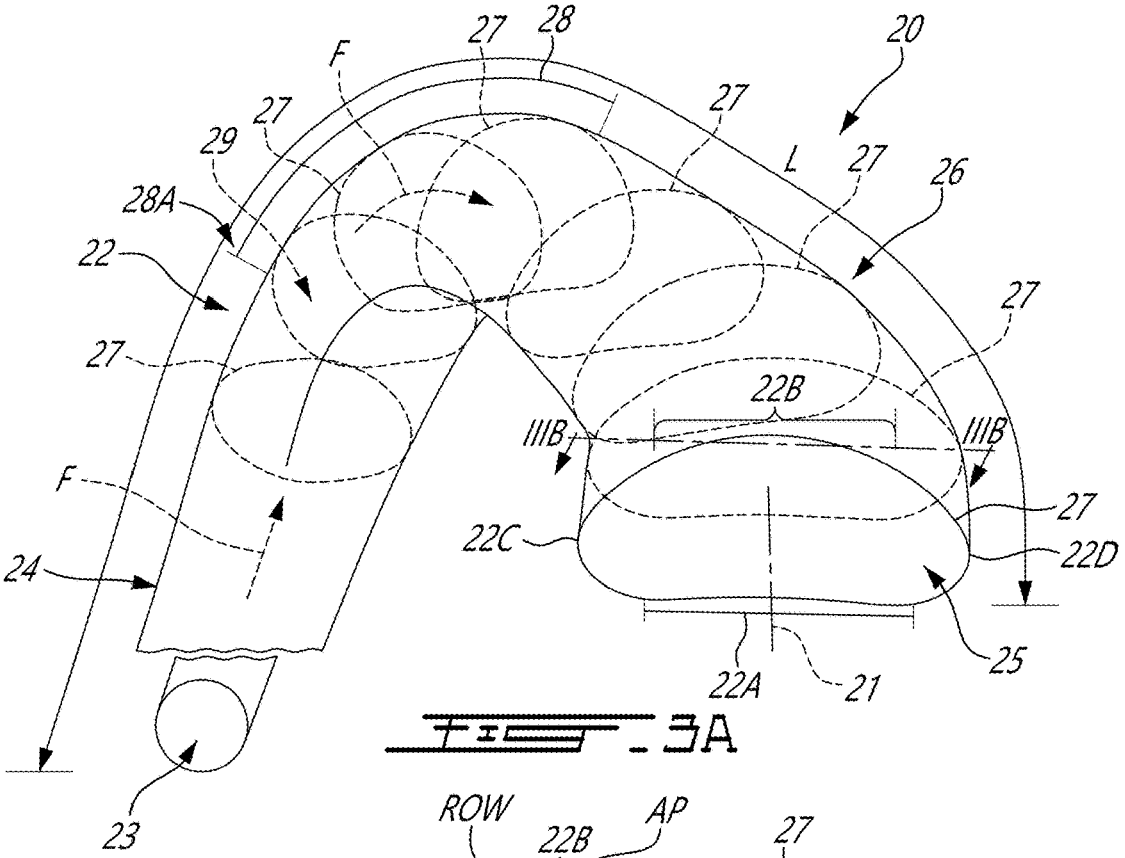
FIG. 3A is a perspective view of a possible configuration for one of the diffuser pipes of FIG. 2.

Referring to FIG. 3A, the tubular body 22 of each diffuser pipe 20 has a radially inner wall 22A and a radially outer wall 22B. The radially outer wall 22B is spaced further from the center axis 11 than the radially inner wall 22A. The tubular body 22 also has a first side wall 22C spaced circumferentially apart across the flow passage 29 from a second side wall 22D. The first and second side walls 22C,22D are curved. The first and second side walls 22C, 22D have a non-zero curvature value. The first and second side walls 22C,22D are concave when viewed from the center axis 11 or from within the tubular body 22, and are convex when viewed from outside the diffuser pipe 20. The radially inner and outer walls 22A,22B and the first and second side walls 22C,22D meet and are connected to form the enclosed flow passage 29 extending through the tubular body 22. The radially inner and outer walls 22A,22B and the first and second side walls 22C,22D meet and are connected to form a peripheral edge of the tubular body 22 which circumscribes the pipe outlet 25. The radially inner wall 22A may correspond to the wall of the tubular body 22 that has the smallest turning radius at the bend portion 28, and the radially outer wall 22B may correspond to the wall of the tubular body 22 that has the largest turning radius at the bend portion 28.

The tubular body 22 diverges in the direction of fluid flow F therethrough, in that the internal flow passage 29 defined within the tubular body 22 increases in cross-sectional area between the inlet 23 and the pipe outlet 25 of the tubular body 22. This increase in cross-sectional area of the flow passage 29 through each diffuser pipe 20 may be continuous along the complete length of the tubular body 22, or the cross-sectional area of the flow passage 29 may increase in gradual increments along the length of the tubular body 22. In the depicted embodiment, the cross-sectional area of the flow passage 29 defined within the tubular body 22 increases gradually and continuously along its length, from the inlet 23 to the outlet 25. The direction of fluid flow F is along a pipe center axis 21 of the tubular body 22. The pipe center axis 21 extends through each of the first, second, and bend portions 24,26,28 and has the same orientation as these portions. The pipe center axis 21 is thus curved. In the depicted embodiment, the pipe center axis 21 is equidistantly spaced from the radially inner and outer walls 22A, 22B of the tubular body 22, and from the first and second side walls 22C,22D, through the tubular body 22.

Referring to FIG. 3A, the tubular body 22 has a length L defined from the inlet 23 to the pipe outlet 25. The length L of the tubular body 22 may be measured as desired. For example, in FIG. 3A, the length L is the length of the pipe center axis 21 from the inlet 23 to the pipe outlet 25. In an alternate embodiment, the length L is measured along one of the walls 22A,22B,22C,22D of the tubular body 22, from the inlet 23 to the pipe outlet 25. Reference may be made herein to positions on the tubular body 22 along its length L. For example, a position on the tubular body 22 that is along a last 10% of the length L is anywhere in the segment of the tubular body 22 that is upstream of the pipe outlet 25 a distance equal to 10% of the length L. This same segment is also downstream of the inlet 23 a distance equal to 90% of the length L. Similarly, a position on the tubular body 22 that is along a first 90% of the length L is anywhere in the segment of the tubular body 22 that is downstream of the inlet 23 a distance equal to 90% of the length L. This same segment is also upstream of the pipe outlet 25 a distance equal to 10% of the length L.

The tubular body 22 is composed of many cross-sectional profiles 27 which are arranged or stacked one against another along the length L of the tubular body 22. Each cross-sectional profile 27 is a planar contour that lies in its own plane that is transverse or normal to the pipe center axis 21. FIG. 3A shows multiple cross-sectional profiles 27 in every portion 24,26,28 of the tubular body 22, and it will be appreciated that many more cross-sectional profiles 27 may be defined at other locations along the pipe center axis 21. In the depicted embodiment, the orientation of the cross-sectional profiles 27 in the frame of reference of the diffuser pipe 20 may vary over the length L of the tubular body 22, depending on where the cross-sectional profiles 27 are located along the pipe center axis 21. Each cross-sectional profile 27 defines the shape, contour, or outline of the tubular body 22 at a specific location along the pipe center axis 21. Each cross-sectional profile 27 shows the shape, contour, or outline of the tubular body 22, as defined by its interconnected walls 22A,22B,22C,22D, at a specific location along the pipe center axis 21.

Referring to FIG. 3A, and as described in greater detail below, the cross-sectional profiles 27 may vary over the length L of the tubular body 22. The cross-sectional profiles 27 are different over the length L of the tubular body 22. Each cross-sectional profile 27 may be unique, and thus different from the other cross-sectional profiles 27. An area of the cross-sectional profiles 27 varies along the length L of the tubular body 22. The area of a given cross-sectional profile 27 is defined between the inner, outer, first side, and second side walls 22A,22B,22C,22D in the cross-sectional profile 27. The area of the cross-sectional profiles 27 increases over the length L of the tubular body 22 in the direction of the pipe outlet 25. This is consistent with the diverging flow passage 29 defined by the tubular body 22.

Figure 3B:
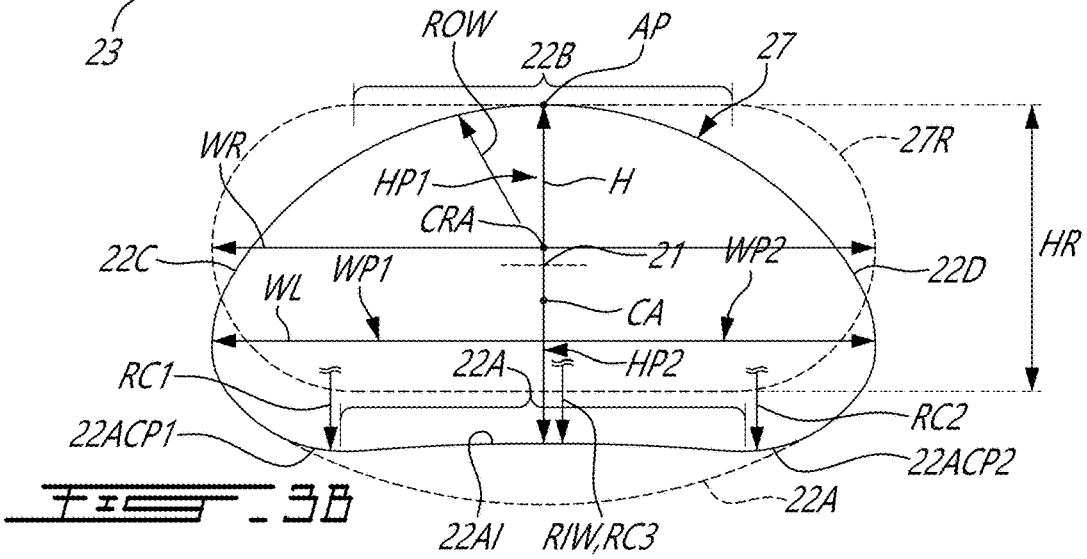
FIG. 3B is a view of a cross-sectional profile of the diffuser pipe of FIG. 3A, taken along the line IIIB-IIIB.

FIG. 3B shows one such cross-sectional profile 27 taken along the line IIIB-IIIB in FIG. 3A, which is at the pipe outlet 25. Referring to FIG. 3B, both the radially outer wall 22B and the radially inner wall 22A are curved at the pipe outlet 25. The radially inner and outer walls 22A,22B have a curvature greater than zero. The radially inner and outer walls 22A,22B have a radius of curvature that is less than infinity. The radially outer wall 22B curves in a direction toward the center axis 11, such that it is concave when viewed from the center axis 11 and convex when viewed from outside the diffuser pipe 20. The pipe outlet 25 in FIG. 3B is thus free of planar portions. The radially inner and outer walls 22A,22B and the side walls 22D are curved along all or substantially all of their lengths. The radially inner and outer walls 22A,22B and the side walls 22D have curvatures greater than zero along all or substantially all of their lengths. The radially inner and outer walls 22A,22B and the side walls 22D are free of straight lines along all or substantially all of their lengths.

Referring to FIG. 3B, the pipe outlet 25 is symmetric about a line H defining a height of the tubular body 22. The pipe outlet 25 thus has the same shape or contour on each side of the line H. When one half of the pipe outlet 25 is folded about the line H, it will have the same shape as the other half of the pipe outlet 25. Referring to FIG. 3B, the line H extends between the radially inner and outer walls 22A, 22B. The line H extends generally radially to the center axis 11, where "generally radially" is understood to mean that the line H may have axial, radial, and/or circumferential directional components, but that the axial and circumferential directional components are much smaller in magnitude than the radial directional component. Referring to FIG. 3B, the line H defines the maximum height of the tubular body 22 between an apex point AP on the radially outer wall 22B and the furthest point from the apex point AP on the radially inner wall 22A, defined along a generally radial direction. Referring to FIG. 3B, the line H is defined between radially spaced-apart maxima and minima on the radially outer wall 22B and the radially inner wall 22A, respectively. Referring to FIG. 3B, the line H is a generally radial line relative to the center axis 11 that extends from an inflection point on the curved, radially outer wall 22B to a point on the radially inner wall 22A. Referring to FIG. 3B, the line H extends through the pipe center axis 21.

The diffuser pipe 20 disclosed herein therefore has, for one or more locations along its length L, a cross-sectional profile 27 that is curved along both of its radially inner and outer walls 22A,22B, and which is symmetrical about a generally radial line through the cross-sectional profile 27. This shape for the cross-sectional profile 27 may be referred to as an elliptical polygon (or "elliptogon"). As described in greater detail below, other similar shapes for the cross-sectional profiles 27 of the diffuser pipe 20 are also possible, such that the present disclosure presents different diffuser pipe 20 cross sectional shapes that may improve the stiffness of the diffuser pipe 20 stiffness by increasing its moment of inertia while maintaining its performance.

The shapes for the cross-sectional profile 27 may help to increase the dynamic stiffness of the diffuser pipe 20 while retaining its aerodynamic performance. The diffuser pipe 20 is joined to the casing of the impeller 17 such that the tubular body 22 is cantilevered from the point of attachment and is subjected to bending or flexion. The tubular body 22 at the inlet 23 may have a flange or other mounting member that may be fastened to the casing of the impeller 17 to fixedly attach the diffuser pipe 20 to the casing. The unattached remainder of the diffuser pipe 20, and the pipe outlet 25, "overhangs" and is free of other structural support, such that they are cantilevered from the casing. This may cause a movement of the pipe outlet 25 toward and away from the center axis 11, a movement sometimes referred to as "flapping", during operation of the engine 10. Additionally, the shapes of the cross-sectional profile 27 as described herein (including the elliptogon, kidney and peanut shapes) may provide an increase in the area moment of inertia of the diffuser pipes 20 relative to typical, elliptically shaped, pipe such as that of the reference cross-sectional profile 27R. The area moment of inertia of the cross-sectional profile 27 is a property which can be used to predict deflection and/or bending stress of the pipe having such a cross-sectional profile. Because the proposed shapes of the cross-sectional profile 27 have a greater area moment of inertia relative to a corresponding elliptical profile 27R, the diffuser pipe 20 having such a cross-sectional profile 27 may be stiffer and thereby increasing its natural frequency.

By providing the cross-sectional profile 27 with the shapes, it may be more difficult for the pipe outlet 25 to displace radially during operation of the engine 10 such that the diffuser pipe 20 is stiffened. By providing the cross-sectional profile 27 with the shapes, it may be possible to increase an area moment of inertia (i.e. a property of a shape used to predict deflection and bending stress). Since the cross-sectional profile 27 with the shapes may increase the moment of inertia, the diffuser pipe 20 may be stiffer, thereby increasing a natural frequency of the diffuser pipe 20. By providing the cross-sectional profile 27 with the shapes, it may thus be possible to change the natural frequency of the diffuser pipe 20, such that the natural frequency is outside the range of certain vibratory frequencies which can exist within the engine operating envelope and can cause cracking and fatigue of the diffuser pipe 20. By providing the cross-sectional profile 27 with the shapes, it may be possible to tune or select the natural frequency of the diffuser pipe 20 such that the natural frequency does not coincide with engine dynamics excitation frequencies over the entire engine operating range. Providing the cross-sectional profile 27 with the shapes may allow the length L of the diffuser pipe 20 to be increased without negatively impacting its vibrational response or its aerodynamic response, and thus make such a longer diffuser pipe 20 suitable for use in an engine 10 with increased power or size. Furthermore, providing the diffuser pipe 20 with the shapes of the cross-sectional profile 27 may not require expensive manufacturing techniques or retooling. By making the cross-sectional profile 27 "taller" by curving radially outwardly the radially outer wall 22B, it may be possible to stiffen the diffuser pipe 20 against flexion or bending motions.

There are many possible shapes for the cross-sectional profiles 27 within the scope of the present disclosure. For example, and referring to FIG. 3B, the shape of the cross-sectional profile 27 at the pipe outlet 25 is an elliptical polygon (sometimes referred to as an elliptogon). The shape of the cross-sectional profile 27 at the pipe outlet 25 is not oblong, where an oblong shape is an elongated rectangle or oval with parallel sides. The shape of the pipe outlet 25 is not oval. The shape of the pipe outlet 25 is different from a shape defined by two semi-circles with the same radius spaced apart and interconnected by parallel lines. The shape of the pipe outlet 25 has all curved lines represented by the radially inner and/or outer walls 22A,22B and side walls 22D. The shape of the pipe outlet 25 is free of parallel lines. Some conventional pipes, in contrast, have oblong, elliptical and symmetrical cross-sectional shapes along the downstream region of the diffuser pipe. Some non-limiting examples of specific shapes for the cross-sectional profiles 27 are now described in greater detail.

Referring to FIG. 3B, the shape for the pipe outlet 25 may be referred to as an elliptical polygon (or "elliptogon"). A radius of curvature ROW of the curved radially outer wall 22B is different from a radius of curvature RIW of the curved radially inner wall 22A. The radii of curvature ROW,RIW have different values, such that the curvatures of the radially inner and outer walls 22A,22B are different. In the shape of the pipe outlet 25 shown in FIG. 3B, the curvature of the radially inner wall 22A is much smaller than the curvature of the radially outer wall 22B. The radius of curvature RIW for the radially inner wall 22A is therefore much larger than the radius of curvature ROW of the radially outer wall 22B. For example, the radially inner wall 22A may have a curvature value of very small magnitude, particularly in comparison to the curvature value of the radially outer wall 22B. For example, and referring to FIG. 3B, a middle portion of the radially inner wall 22A around the line H is slightly curved, but the magnitude of its curvature is small and orders of magnitude less than the curvature of the radially outer wall 22B. In an embodiment, the radius of curvature RIW of the radially inner wall 22A tends toward infinity, and the radially inner wall 22A is represented in the cross-sectional profile 27 as an almost straight line being transverse to the line H. Referring to FIG. 3B, the line H is perpendicular to the almost straight radially inner wall 22A.

The apex point AP is a point on the line H. The apex point AP is the location on the radially outer wall 22B that is furthest from the center axis 11. The apex point AP is the location on the radially outer wall 22B at which there is an inflection point in the curve of the radially outer wall 22B. The apex point AP is the location on the radially outer wall 22B at which the tangent to the curve of the radially outer wall 22B changes between a negative value for the slope of the tangent line and a positive value for the slope. From the apex point AP, the radially outer wall 22B curves in a direction toward the radially inner wall 22A (i.e. a radially inward direction) toward a radially outer end of each of the first and second side walls 22C,22D. The radially outer wall 22B has two curved segments on either side of the line H. From the apex point AP, each of the curved segments curves in a direction away from the apex point AP and toward the radially inner wall 22A, and joins to a radially outer end of one of the first and second side walls 22C,22D.

Referring to FIG. 3B, the pipe outlet 25 includes a width line WL extending between points of the first and second side walls 22C,22D that are disposed furthest from one another. The length of the width line WL corresponds to the largest width of the pipe outlet 25, where the width is defined between the first and second side walls 22C,22D. The width line WL may or may not extend through the pipe center axis 21. The width line WL intersects the line H defining the height of the tubular body 22 and divides the line H into a first height portion HP1 extending between the apex point AP on the radially outer wall 22B and the width line WL, and a second height portion HP2 extending between the radially inner wall 22A and the width line WL. The length of the first and second height portions HP1,HP2 are parameters which can be selected by a designer of the diffuser pipe 20 to obtain the desired shape for the pipe outlet 25. For the pipe outlet 25 disclosed herein, a ratio of the first height portion HP1 over the second height portion HP2 (i.e. HP1/HP2) may be between about 1.1 and 4. The first height portion HP1 is thus always greater than the second height portion HP2, by a factor ranging in value from 1.1 to 4. This range of ratios helps to ensure that the radially outer wall 22B is curved, such that the shape of the pipe outlet 25 may be the desired elliptical polygon through the range of ratio values.

Referring to FIG. 3B, the line H defining the height intersects the width line WL and divides the width line into a first width portion WP1 extending between one of the first and second side walls 22C,22D and the line H, and a second width portion WP2 extending between the other of the first and second side walls 22C,22D and the line H. The length of the first and second width portions WP1,WP2 are parameters which can be selected by a designer of the diffuser pipe 20 to obtain the desired shape for the pipe outlet 25. For the pipe outlet 25 disclosed herein, a ratio of the first width portion WP1 over the second width portion WP2 (i.e. WP1/WP2) may be approximately 1. The first width portion WP1 is thus equal to the second width portion WP2. This helps to ensure that the pipe outlet 25 is symmetrical about the line H defining the height of the tubular body 22, such that the shape of the pipe outlet 25 may be the desired elliptical polygon. Referring to FIG. 3B, the ratio of the first width portion WP1 over the second width portion WP2 remains approximately 1 at all points along the line H, such that the first side wall 22C and the second side wall 22D are both symmetrical about the line H at all radial points thereon. The pipe outlet 25 in FIG. 3B is a symmetric elliptogon shape. In an alternative possible shape for the pipe outlet 25 that is asymmetrical about the line H, the ratio of the first width portion WP1 over the second width portion WP2 may be between 0.2 and 5, such that the asymmetry of the pipe outlet 25 may be on either side of the line H. Referring to FIG. 3B, the pipe outlet 25 is asymmetric about the width line WL. The shape or contour of the pipe outlet 25 is different on each radially-opposite side of the width line WL. The radially outer wall 22B and the radially inner wall 22A are not symmetrical about the width line WL.

Although the cross-sectional profile 27 at the pipe outlet 25 has a shape different from the oblong or pure ellipse cross-sectional shape of a conventional pipe, the cross-sectional profile 27 may have the same area and/or same parameters as a conventional oblong or pure ellipse cross-sectional shape. Referring to FIG. 3B, a reference cross-sectional profile 27R is defined in the plane normal to the pipe center axis 21 at the same location along the pipe center axis 21 as the pipe outlet 25. The reference cross-sectional profile 27R is shaped as an ellipse and defines a reference width WR along a major axis and a reference height HR along a minor axis. The shape of the pipe outlet 25 is different than the ellipse shape of the reference cross-sectional profile 27R. Despite the differences in shape, the reference width WR of the reference cross-sectional profile 27R is equal to the width of the pipe outlet 25, represented in FIG. 3B by the width line WL. In some designs for diffuser pipes 20, the width of the flow passage 29 is an important design parameter affecting the aerodynamic performance of the diffuser pipe 20. Therefore, by equating the width of the cross-sectional profile 27 to the width of a conventional elliptical cross-sectional shape for a pipe, the designer of the diffuser pipe 20 is able to better benchmark the aerodynamic performance of the diffuser pipe 20 against a conventional "elliptical" diffuser pipe. Furthermore, the circumferential envelope of the diffuser pipe 20 may be the same as that of a conventional "elliptical" diffuser pipe because their widths are the same, such that no reconfiguration or redesign of engine components near the diffuser pipes 20 may required. In an embodiment, the maximum height, measured along a general radial line to the center axis 11, of the cross-sectional profile 27 is equal to the maximum height HR of the reference cross-sectional profile 27R.

Referring to FIG. 3B, the area of the cross-sectional profile 27 at the pipe outlet 25 is equal to the area of the reference cross-sectional profile 27R. Thus, despite the cross-sectional profile 27 at the pipe outlet 25 having a shape different from the oblong or pure ellipse cross-sectional shape of a conventional pipe, the aerodynamic performance of the diffuser pipe 20 may be compared or benchmarked against that of a conventional "elliptical" diffuser pipe because their cross-sectional areas are the same. Furthermore, the radial and circumferential envelope of the diffuser pipe 20 may be the same as that of a conventional "elliptical" diffuser pipe because their cross-sectional areas are the same, such that no reconfiguration or redesign of engine components near the diffuser pipes 20 may be required. It can thus be appreciated that the cross-sectional area of the diffuser pipe 20 is not changed compared to a conventional diffuser pipe, just its shape. The cross-sectional width of the diffuser pipe 20 may also remain the same as the cross-sectional width of a conventional diffuser pipe. Referring to FIG. 3B, a center of area CA of the cross-sectional profile 27 at the pipe outlet 25 is closer to the radially inner wall 22A than a center of the reference area CRA of the reference cross-sectional profile 27R is closer to its radially inner wall. The cross-sectional profile 27 thus has a "lower" or "dropped" (i.e. disposed closer to the center axis 11) center of area CA than the center of the reference area CRA, despite both cross-sectional profiles 27,27R having the same area.

Referring to FIG. 3B, the radially inner wall 22A has a compound curvature. The radially inner wall 22A in the cross-sectional profile 27 shown is made up of two or more curves with different radii that bend the same way and are on the same side of a common tangent. Thus, the radius of curvature RIW of the radially inner wall 22A varies, or does not remain constant, between the side walls 22D.

Referring to FIG. 3B, the compound curve of the radially inner wall 22A has a first curved portion 22ACP1 joined to one of the side walls 22D and having a first radius of curvature RC1, a second curved portion 22ACP2 joined to the other of the side walls 22D and having a second radius of curvature RC2, and a third curved portion 22A1 between the first and second curved portions 22ACP1,22ACP2 having a third radius of curvature RC3. The first and second curved portions 22ACP1,22ACP2 are similarly curved, such that the first radius of curvature RC1 is approximately equal to the second radius or curvature RC2. The third curved portion 22A1 is curved differently from the curvature of first and second curved portions 22ACP1,22ACP2, such that the third radius of curvature RC2 is different from the first and second radii of curvature RC1,RC2. The third curved portion 22A1 defines an apex point of the radially inner wall 22A, which is the point on the radially inner wall 22A that is furthest from the center axis 11. The first and second curved portion 22ACP1,22ACP2 each define proximal points of the radially inner wall 22A, which are the points on the radially inner wall 22A that are closest to the center axis 11. At each of the apex and proximal points, tangents to the radially inner wall 22A are define which are parallel to the width line WL. Thus, in the shape of the pipe outlet 25 shown in FIG. 3B, at least the radially inner wall 22A has multiple and different radii of curvature. Still referring to FIG. 3, the radius of curvature ROW of the radially outer wall 22A remains substantially constant, or is a simple curve, throughout its length between the side walls 22D. The radius of curvature ROW of the radially outer wall 22B does not define a compound curve.

Figure 3C:
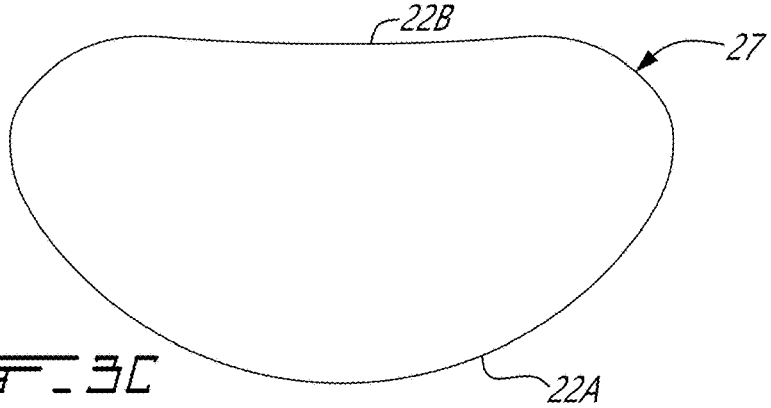
FIG. 3C is a view of another cross-sectional profile of another diffuser pipe.

Other elliptical polygon shapes for the cross-sectional profile 27 are possible and within the scope of the present disclosure. For example, and referring to FIG. 3C, the elliptical polygon shape of the cross-sectional profile 27 of FIG. 3B is flipped or inverted. In FIG. 3C, the radially inner wall 22A of the cross-sectional profile 27 has a curvature greater than the curvature of the radially outer wall 22B. The disclosure above related to the curved radially inner and outer walls 22A,22B of FIG. 3B applies mutatis mutandis to the curved radially inner and outer walls 22A,22B of FIG. 3C. Such an inverted shape for the cross-sectional profile 27 in FIG. 3C may provide the same stiffening structural benefits to the diffuser pipe 20 that are described above. Another possible elliptical polygon shape for the cross-sectional profile 27 is shown in FIG. 3B, in which the radially inner wall 22A is curved outwardly relative to the pipe center axis 21.

Yet another possible elliptical polygon shape for the cross-sectional profile 127 is described with reference to FIGS. 4A and 4B. Both the radially outer wall 22B and the radially inner wall 22A of the cross-sectional profile 127 are curved. The cross-sectional profile 127 has a peanut or kidney shape, in that part of the radially inner wall 22A protrudes toward the radially outer wall 22B. More particularly, and referring to FIG. 4B, the radially inner wall 22A is a compound curve that has an indented portion 22A1 (corresponding to the third curved portion 22A1 described above) that extends toward the radially outer wall 22B. The indented portion 22A1 is a local depression in the radially inner wall 22A. The indented portion 22A1 is symmetrical about the line H defining the height of the tubular body 22. The indented portion 22A1 includes a peak point PP that is on a radial line from the center axis 11 and on the line H. The indented portion 22A1 includes the portions of the radially inner wall 22A that are positioned furthest from the center axis 11. Referring to FIG. 4B, the radially inner wall 22A has two lateral portions 22AL (corresponding to the first and second curved portions 22ACP1,22ACP2 described above) disposed on opposite circumferential sides of the indented portion 22A1. The lateral portions 22AL are positioned closer to the center axis 11 than the indented portion 22A1. The lateral portions 22AL are symmetrical about the line H. The disclosure above related to the compound curve of the radially inner wall 22A and the radii of curvature ROW, RIW,RC1,RC2,RC3 of FIG. 3B applies mutatis mutandis to the compound curve of the radially inner wall 22A of FIG. 3C. Referring to FIG. 4B, the first and second side walls 22C,22D are free of any indentations. As the fluid flow F separates on the radially inner side of the diffuser pipe 20 after the bend portion 28, the peanut or kidney shape provided by the indented portion 22A1 of the radially inner wall 22A may have positive aerodynamic effects on the fluid flow F by containing or confining low momentum flow in the "valleys" of the lateral portions 22AL.

Figure 4A:
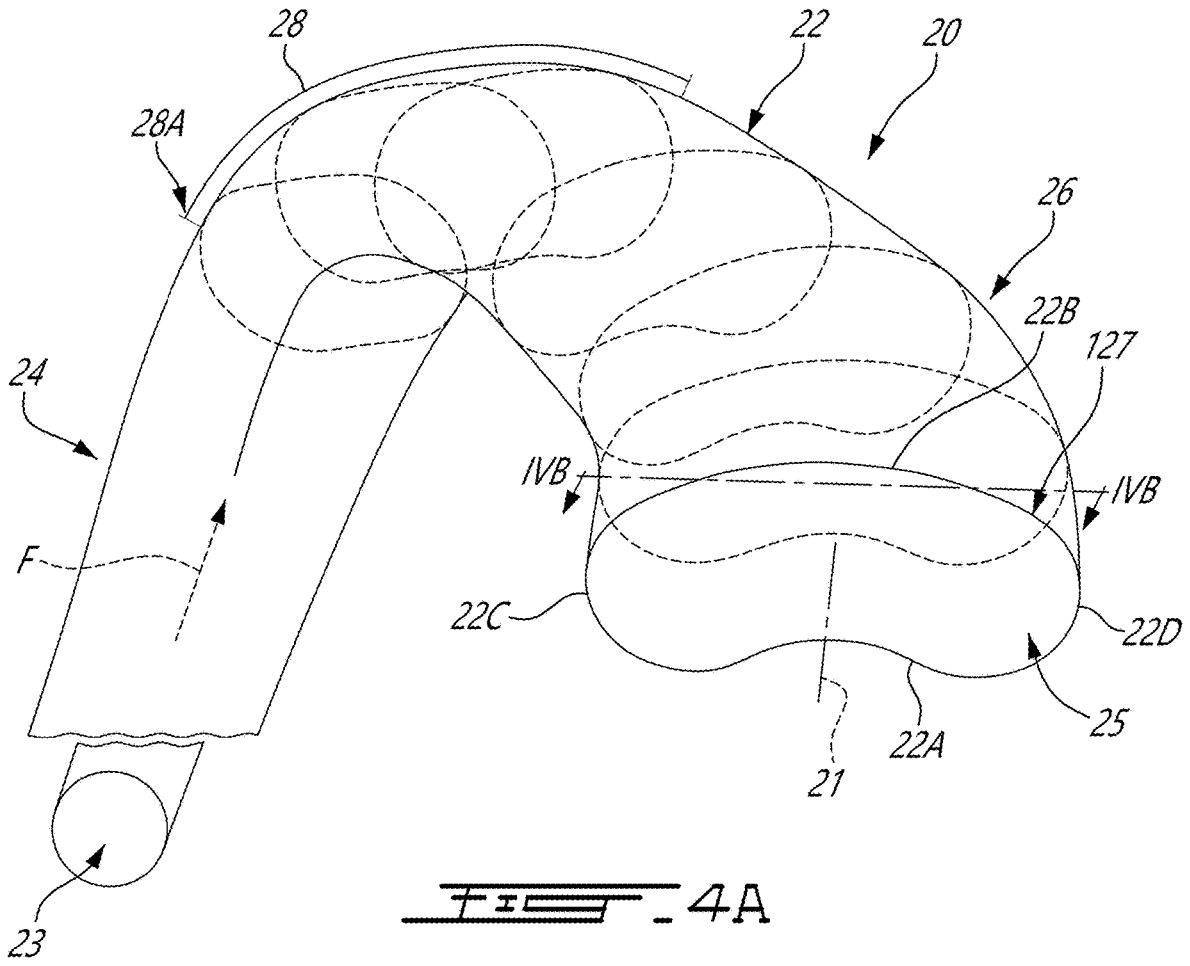
FIG. 4A is a perspective view of another possible configuration for one of the diffuser pipes of FIG. 2.
Figure 4B:
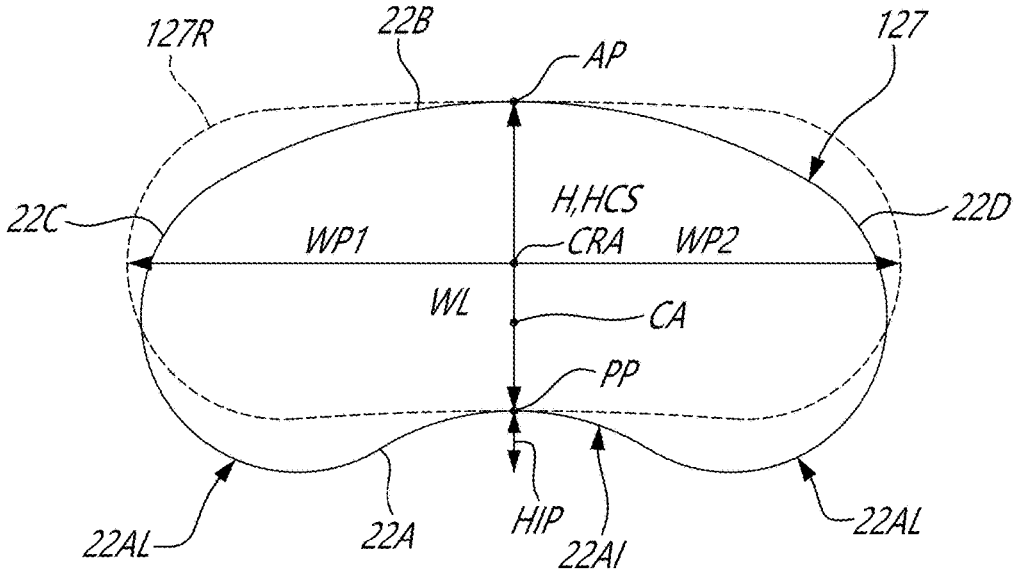
FIG. 4B is a view of a cross-sectional profile of the diffuser pipe of FIG. 4A, taken along the line IVB-IVB.

Referring to FIGS. 4A and 4B, the shape of the cross-sectional profile 127 at the pipe outlet 25 is an elliptical polygon (sometimes referred to as an elliptogon), and more specifically is a kidney shape. The pipe outlet 25 is not oblong, where an oblong shape is an elongated rectangle or oval with parallel sides. The shape of the pipe outlet 25 is not oval. The shape of the pipe outlet 25 is different from a shape defined by two semi-circles with the same radius spaced apart and interconnected by parallel lines. The shape of the pipe outlet 25 has all curved lines represented by the radially inner and/or outer walls 22A,22B and side walls 22D. The shape of the pipe outlet 25 is free of parallel lines. Some conventional pipes, in contrast, have oblong, elliptical or symmetrical cross-sectional shapes along the downstream region of the diffuser pipe.

Referring to FIG. 4B, the peanut or kidney shape may be governed by the ratio of a height HIP of the indented portion 22A1 over a height HCS of the cross-sectional profile 127. The height HIP of the indented portion 22A1 is measured along a line being substantially radial to the center axis 11. The line extends from a first tangent at an inflection point of the curved lateral portions 22AL, to a second tangent at an inflection point of the curved indented portion 22A1. The height HCS of the cross-sectional profile 127 extends between the second tangent and the apex point AP of the radially outer wall 22B. For the cross-sectional profile 127 shown in FIG. 4B, a ratio of the height HIP of the indented portion 22A1 over the height HCS of the cross-sectional profile 127 may be between 0 and 0.3. The height HCS of the cross-sectional profile 127 is thus always greater than the height HIP of the indented portion 22A1. Where the value of the ratio is zero, the radially inner wall 22A have very little curvature. Where the value of the ratio is greater than zero, the range of ratios helps to ensure that the radially inner wall 22A is curved and contributing to the desired peanut or kidney shape of the cross-sectional profile 127. The peanut or kidney shape of the cross-sectional profile 127 may take other forms as well. For example, in one non-limiting example, the radially outer wall 22B also has an indented portion 22A1. For example, in another non-limiting example, the cross-sectional profile 127 is inverted, such that only the radially outer wall 22B has the indented portion 22A1.

Referring to FIG. 4B, the cross-sectional profile 127 is symmetric about the line H defining a height of the tubular body 22. The outlet 25 in FIG. 4B is a symmetrical kidney shape. In an alternative possible shape for the cross-sectional profile 127 that is asymmetrical about the line H, the ratio of the first width portion WP1 over the second width portion WP2 may be such that the asymmetry of the cross-sectional profile 127 may be on either side of the line H. Referring to FIG. 4B, the cross-sectional profile 127 is asymmetric about the width line WL. The shape or contour of the cross-sectional profile 127 is different on each side of the width line WL. The radially outer wall 22B and the radially inner wall 22A are not symmetrical about the width line WL.

Referring to FIG. 4B, the area of the cross-sectional profile 127 is equal to the area of the reference cross-sectional profile 127R that is elliptical and which has the same width WL and the same height measured along the line H. Thus, despite the cross-sectional profile 127 having a shape different from the oblong or pure ellipse cross-sectional shape of a conventional pipe, the aerodynamic performance of the diffuser pipe 20 may be compared or benchmarked against that of a conventional "elliptical" diffuser pipe because their cross-sectional areas are the same. Furthermore, the radial and circumferential envelope of the diffuser pipe 20 may be the same as that of a conventional "elliptical" diffuser pipe because their cross-sectional areas are the same, such that no reconfiguration or redesign of engine components near the diffuser pipes 20 may be required. Referring to FIG. 4B, a center of area CA of the cross-sectional profile 127 is closer to the radially inner wall 22A than a center of the reference area CRA of the reference cross-sectional profile 127R. The cross-sectional profile 127 thus has a "lower" or "dropped" (i.e. disposed closer to the center axis 11) center of area CA than the center of the reference area CRA, despite both cross-sectional profiles 127,127R having the same area.

Although FIGS. 3B and 4B show a single cross-sectional profile 27,127 at a particular location along the diffuser pipe 20, it will be appreciated that the cross-sectional profiles 27,127, as well as any other cross-sectional shapes or contours disclosed herein, may also be present at other locations along the length L of the diffuser pipe 20. Referring to FIGS. 3A and 4A, the elliptogon and/or kidney or peanut cross-sectional profiles 27,127 are present at every point of the pipe center axis 21 from the bend portion 28 to the pipe outlet 25. More particularly, the cross-sectional profiles 27,127 are present along all points of the length L of the tubular body 22 from an upstream end 28A of the bend portion 28 to the pipe outlet 25. The upstream end 28A is the extremity of the bend portion 28 closest to the radially-extending first portion 24. The cross-sectional profiles 27,127 thus extend along all of the length of the bend portion 28 and the second portion 26 to reinforce or stiffen these portions of the diffuser pipe 20. The cross-sectional profiles 27,127 may start at the bend portion 28 and "blend" or become more pronounced (e.g. greater curvature to the radially outer wall 22B, greater height HIP of the indented portion 22A1, etc.) in the direction of the fluid flow F along the pipe center axis 21 toward the pipe outlet 25. In an embodiment, the cross-sectional profiles 27,127 are not present in the radial, first portion 24 of the diffuser pipe 20 since there may be no bending or flexion moment acting on the first portion 24. In an embodiment, the cross-sectional shape along the first portion 24 is elliptical. In an embodiment, the cross-sectional shape of the inlet 23 is circular.

Figure 5A:
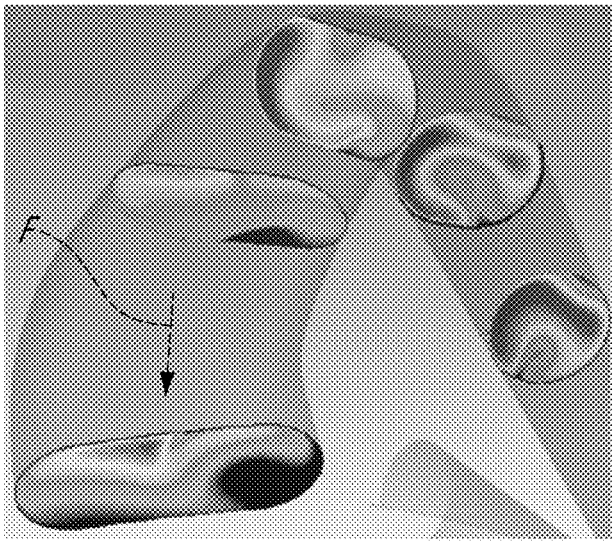
FIG. 5A shows Mach number contours at different cross-sections of a diffuser pipe having a first cross-sectional shape.
Figure 5B:
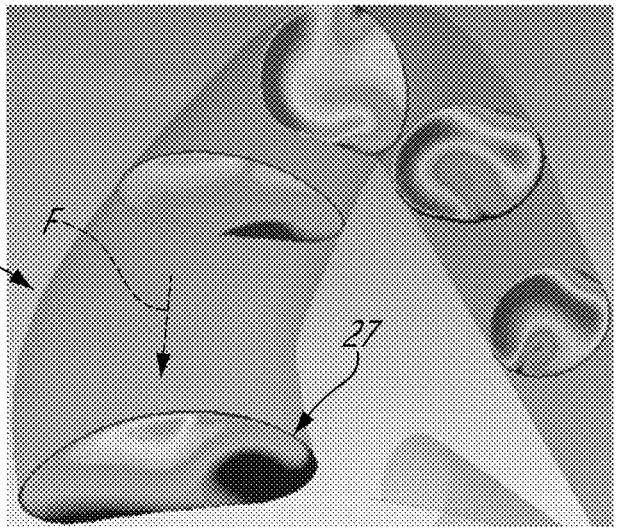
FIG. 5B shows Mach number contours at different cross-sections of a diffuser pipe having a second cross-sectional shape.
Figure 5C:
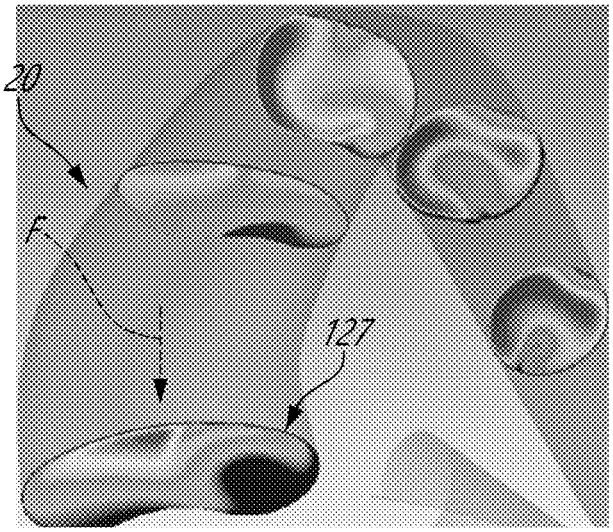
FIG. 5C shows Mach number contours at different cross-sections of a diffuser pipe having a third cross-sectional shape.

FIGS. 5A to 5C compare the Mach number of the fluid flow F through diffuser pipes 20 having different cross-sectional shapes. The cross-sectional shape of the diffuser pipe in FIG. 5A is elliptical, and thus resemble the shape of a conventional diffuser pipe. The cross-sectional shape of the diffuser pipe 20 in FIG. 5B is elliptical polygonal, and is defined by the cross-sectional profile 27. The cross-sectional shape of the diffuser pipe 20 in FIG. 5C is elliptical polygonal with a peanut or kidney shape, and is defined by the cross-sectional profile 127. FIGS. 5A to 5C show that the fluid flow F at various sections along the diffuser pipe is substantially the same for all three cross-sectional shapes, suggesting that the cross-sectional profiles 27,127 disclosed herein may stiffen the diffuser pipe 20 without negatively impacting its aerodynamic performance when compared to an "elliptical" diffuser pipe.

Referring to FIGS. 3A and 4A, there is disclosed a method of stiffening (i.e. reducing the flexion) of the diffuser pipe 20 which is cantilevered at its inlet 23 to the casing of the impeller 17. The method includes providing a cross-sectional profile 27,127 to the diffuser pipe 20 in its bend and/or axial portions 28,26. The cross-sectional profile 27,127 is defined by a curved radially outer wall 22B and has symmetry about the line H defining a height of the diffuser pipe 20.

Referring to FIGS. 3A and 4A, there is disclosed a method of stiffening (i.e. reducing the flexion) of the diffuser pipe 20 which is cantilevered at its inlet 23 to the casing of the impeller 17. The method includes providing a cross-sectional profile 27,127 to the diffuser pipe 20 in its bend and/or axial portions 28,26. The cross-sectional profile 27,127 is defined by a curved radially inner and outer walls 22A,22B, where the radius of curvature ROW of the radially outer wall 22B is different from the radius of curvature RIW of the radially inner wall 22A.

The diffuser pipes 20 disclosed herein may have dimples, which are extrusions or impressions in one of the radially inner and outer walls 22A,22B, in addition to the cross-sectional profiles 27,127 disclosed herein. Dimples may give the diffuser pipe 20 a different natural frequency such that it is out of the range of dynamic frequencies during operation of the engine 10, thereby contributing to tuning the diffuser pipe 20 modes out of running range at high speeds. When employed with dimples, the cross-sectional shapes disclosed herein may help to reduce risks of the diffuser pipe 20 cracking due to high cycle fatigue (HCF).

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A compressor diffuser for an aircraft engine, the compressor diffuser comprising:

a plurality of diffuser pipes disposed circumferentially about a center axis of the compressor diffuser, the center axis extending in an axial direction, each diffuser pipe of the plurality of diffuser pipes:

extending from an inlet of that diffuser pipe to an outlet of that diffuser pipe and increasing in cross-sectional area from the inlet toward the outlet, the outlet opening in the axial direction, at least the outlet defined by a radially inner wall, a radially outer wall, and side walls joining the radially inner wall to the radially outer wall, and both the radially inner wall and the radially outer wall being curved, a radius of curvature of the radially outer wall being different from a radius of curvature of the radially inner wall.

2. The compressor diffuser of claim 1, wherein one or both of the radially outer wall and the radially inner wall has a compound curvature.

3. The compressor diffuser of claim 1, wherein the radially inner wall has a compound curvature and the radius of curvature of the radially inner wall varies between the side walls, the radius of curvature of the radially outer wall being substantially constant between the side walls.

4. The compressor diffuser of claim 1, wherein the radially inner wall has a first curved portion joined to one of the side walls and having a first radius of curvature, a second curved portion joined to the other of the side walls and having a second radius of curvature equal to the first radius of curvature, and a third curved portion between the first and second curved portions having a third radius of curvature different from the first and second radii of curvature.

5. The compressor diffuser of claim 1, wherein the radially inner wall, the radially outer wall, and the side walls are free of planar portions.

6. The compressor diffuser of claim 1, wherein the outlet is elliptigon shaped.

7. The compressor diffuser of claim 6, wherein the outlet is peanut or kidney shaped.

8. The compressor diffuser of claim 1, wherein the outlet is kidney shaped and the radially inner wall has an indented portion, a height of the outlet defined between the radially outer wall and the indented portion, a ratio of a height of the indented portion over the height of the outlet over is between 0 and 0.3.

9. The compressor diffuser of claim 1, wherein the outlet is symmetric about a plane passing through the outlet, the plane containing a line defining a height of the outlet between the radially inner and outer walls.

10. The compressor diffuser of claim 1, wherein a reference cross-sectional profile is defined in a plane normal to a pipe center axis of that diffuser pipe, the reference cross-sectional profile shaped as an ellipse and defining a reference width along a major axis and a reference height along a minor axis, the outlet having a shape different than the ellipse and having a width being equal to the reference width.

11. The compressor diffuser of claim 10, wherein an area of the outlet is equal to a reference area of the reference cross-sectional profile, and a center of area of the outlet is closer to the radially inner wall than a center of the reference area of the reference cross-sectional profile.

12. The compressor diffuser of claim 1, wherein the outlet includes a width line extending between points of the side walls disposed furthest from one another, the width line intersecting a line defining a height of the outlet and dividing the line defining the height into a first height portion extending between the radially outer wall and the width line, and a second height portion extending between the radially inner wall and the width line, a ratio of the first height portion over the second height portion being between about 1.1 and 4.

13. The compressor diffuser of claim 12, wherein the line defining the height intersects the width line and divides the width line into a first width portion extending between one of the side walls and the line defining the height, and a second width portion extending between the other of the side walls and the line defining the height, a ratio of the first width portion over the second width portion being about 1.

14. The compressor diffuser of claim 1, wherein the radius of curvature of the radially outer wall is different from the radius of curvature of the radially inner wall along a length of the diffuser pipe extending from the outlet to a bend in the diffuser pipe.

15. The compressor diffuser of claim 1, wherein the radially inner wall has an indented portion extending toward the radially-outer wall.

16. The compressor diffuser of claim 15, wherein the indented portion is symmetrical about a line defining a height of the outlet.

17. A diffuser pipe, comprising: a tubular body extending from an inlet to an outlet and increasing in cross-sectional area from the inlet toward the outlet, the outlet having a radially inner wall, a radially outer wall, and side walls joining the radially inner wall to the radially outer wall, the outlet having an elliptigon shape in which both the radially inner wall and the radially outer wall are curved, a radius of curvature of the radially outer wall being different from a radius of curvature of the radially inner wall.

18. The diffuser pipe of claim 17, wherein the radially inner wall has a compound curvature and the radius of curvature of the radially inner wall varies between the side walls, the radius of curvature of the radially outer wall being substantially constant between the side walls.

19. The diffuser pipe of claim 17, wherein the radially inner wall has a first curved portion joined to one of the side walls and having a first radius of curvature, a second curved portion joined to the other of the side walls and having a second radius of curvature equal to the first radius of curvature, and a third curved portion between the first and second curved portions having a third radius of curvature different from the first and second radii of curvature.

20. The diffuser pipe of claim 17, wherein the outlet is kidney shaped and the radially inner wall has an indented portion, a height of the outlet defined between the radially outer wall and the indented portion, a ratio of a height of the indented portion over the height of the outlet over is between 0 and 0.3.

* * * * *